United States Patent [19]

Perry

[11] Patent Number: 4,863,050

[45] Date of Patent: Sep. 5, 1989

[54] TAMPER INDICATING PACKAGE AND MOLDED PLASTIC THREADED CLOSURE THEREFOR

[75] Inventor: Robert A. Perry, Toledo, Ohio

[73] Assignee: Owens-Illinois Closure Inc., Toledo, Ohio

[21] Appl. No.: 245,235

[22] Filed: Sep. 16, 1988

[51] Int. Cl.[4] ..... B65D 41/34

[52] U.S. Cl. ..... 215/252

[58] Field of Search ..... 215/252, 253

[56] References Cited

U.S. PATENT DOCUMENTS

| | | | |
|---|---|---|---|
| 3,417,893 | 12/1968 | Lieberman | 215/9 |
| 4,153,174 | 5/1979 | Keeler | 215/252 |
| 4,190,169 | 2/1980 | Pehr | 215/252 |
| 4,196,818 | 4/1980 | Brownbill | 215/252 |
| 4,401,227 | 8/1983 | Pehr | 215/252 |
| 4,488,655 | 12/1984 | Itsubo et al. | 215/252 |
| 4,497,765 | 2/1985 | Wilde et al. | 215/252 |
| 4,572,388 | 2/1986 | Luker et al. | 215/252 |
| 4,595,110 | 6/1986 | Herr | 215/252 |

*Primary Examiner*—Donald F. Norton

[57] ABSTRACT

A tamper indicating package including a bottle and a molded plastic closure removably secured to the finish portion of the bottle by engaging helical threads on the outside of the bottle finish and the inside of an annular skirt portion of the closure, respectively. The closure is provided with at least one aperture in the annular skirt and a flexible finger on the outside of the annular skirt in radial alignment with the aperture. The flexible finger has a lower end which is affixed to the annular skirt and an upper free end, and the upper free end is deflected inwardly through the aperture, after the molding of the closure, to engage the underside of an annular bead on the finish of the bottle in an interference fit. The annular skirt of the closure is scored along a line above the lower end of the flexible finger to form a breakaway ring in the lower portion of the annular skirt which is frangible with respect to the portion of the closure skirt thereabove and which separates therefrom upon the first opening or attempted opening of the package.

46 Claims, 3 Drawing Sheets

TAMPER INDICATING PACKAGE AND MOLDED PLASTIC THREADED CLOSURE THEREFOR

BACKGROUND OF THE INVENTION

1. Field Of The Invention

This invention relates to a molded plastic closure for a container and to a package which is made up of a container with such a molded plastic closure affixed thereto. More particularly, this invention relates a tamper indicating, molded plastic closure with an inwardly projecting helical thread by which such a closure may be affixed to and removed from the finish of a bottle with an outwardly projecting helical thread that is complemental to the helical thread of the closure, and to a package which is made up of such a bottle and such a molded plastic closure affixed thereto 2. Description Of The Prior Art U.S. Pat. No. 4,595,110 (J.E. Herr) discloses a bottle with a molded plastic, tamper indicating, internally threaded closure applied to an externally threaded finish portion of such bottle. The closure of this reference derives its tamper indicating characteristics from a series of tabs which are formed at the lower margin of a ring which, in turn, is frangibly integrally attached to the lower margin of an annular skirt of the closure. The tabs are mechanically repositioned after the closure is formed, to extend inwardly and upwardly from the ring to engage an annular bead or ring on the finish of the bottle in an interference fit, and to thereby cause the ring to break away from the skirt of the closure upon the first removal or attempted removal of the closure from the bottle to provide a visible indication of a prior opening or attempted opening of the bottle. A closure of this type requires extra material, relative to other types of tamper indicating molded plastic closures, to form the tabs which extend from the breakaway ring, and, hence, is more expensive in terms of material costs than such other types of tamper indicating molded plastic closures.

U.S. Pat. No. 4,401,227 (H.T. Pehr) also discloses a bottle with a molded plastic, tamper indicating, internally threaded closure applied to an externally threaded finish portion of such a bottle. It would appear that the closure of this reference uses less material than that of the Herr reference, since the closure of this reference avoids the need for the breakaway ring of the Herr reference by relying on breakaway tabs which are directly attached to the skirt of the closure and which engage an annular shoulder on the bottle and break away from the closure upon the first removal or attempted removal of the closure from the bottle. However, because of the complexity of the design of this closure, it is believed that it cannot be produced by a molding technique in which the closure can be stripped away from the mold tooling used in it manufacture, which is a faster and hence less expensive molding technique than the alternative molding technique in which the closure must be unscrewed from the mold tooling, and it is not clear that the closure of this reference can be affixed to a standard glass or plastic container finish, which is preferable whenever possible since bottles with standard finishes are less costly to manufacture than comparable bottles with special finishes.

U.S. Pat. Nos. 3,417,893 (H.G. Lieberman); 4,153,174 (F.D. Keeler); 4,190,169 (H.T. Pehr); 4,196,818 (T.D. Brownbill); and 4,488,655 (J. Itsubo et al.) disclose other types of molded plastic tamper indicating, internally threaded closures, but for various reasons the closures of these references also fail to provide the features and advantages of the closure of the present invention.

SUMMARY OF THE INVENTION

According to the present invention there is provided a tamper indicating, molded plastic closure which is provided with an internally projecting helical thread by which such closure may be applied to and removed from an externally threaded bottle finish, together with a package which is made up of a bottle and a closure of the foregoing character affixed to the finish of the bottle. The closure of the present invention utilizes less material than other known types of tamper indicating closures and can be rapidly and relatively inexpensive produced by standard injection molding techniques since its design permits it to be stripped from the molding tooling. Such a closure is provided with one or more openings in the skirt of the closure and a flexible finger which is formed from the outside of the closure skirt at the location of each such opening. After the closure is removed from the molding tooling, and before the closure is applied to the finish of a bottle, a free end at the top of each of the flexible fingers is forced through the adjacent opening in the closure skirt so that it is positioned to engage a shoulder on the finish of a bottle when such closure is affixed thereto, to form an interference fit between the tip of the flexible finger and the shoulder on the bottle. The closure skirt is scored in a circumferential pattern above the locations of the connections of the flexible fingers to form a breakaway ring which separates from the portion of the skirt thereabove upon the first removal or attempted removal of the closure of the container. Because the flexible fingers are initially positioned on the outside of the closure skirt, they are out of interference with the tooling that is used to form the inside of the closure, which is usually referred to as the core pin in an injection molding operation, and the closure may be stripped from such tooling to speed up, and thereby reduce the cost of, the molding operation.

Accordingly, it is an object of the present invention to provide an improved molded plastic, tamper indicating closure for a bottle and it is a corollary object to provide a tamper indicating package which is made up of a bottle with a closure of the foregoing character affixed thereto. It is a further object of the present invention to provide an improved molded plastic tamper indicating closure with an inwardly projecting helical thread by which such a closure may be applied to and removed from the finish of a bottle having an outwardly projecting helical thread which is complemental to the helical thread of the closure, and it is further corollary object of the present invention to provide a tamper indicating package which is made up of a bottle with a finish with an outwardly projecting helical thread and a closure of the foregoing character affixed thereto. It is also an object of the present invention to provide a molded plastic, tamper indicating closure with an inwardly projecting helical thread which may be manufactured by a molding technique in which the closure is stripped from the portion of the molding tooling which is used to form the inside of the closure. For a further understanding of the present invention and the objects thereof, attention is directed to the drawing and the following brief description thereof, to the detailed description of the preferred embodiment and to the appended claims.

DETAILED DESCRIPTION OF THE PREFERRED EMBODIMENT

Figure 2:
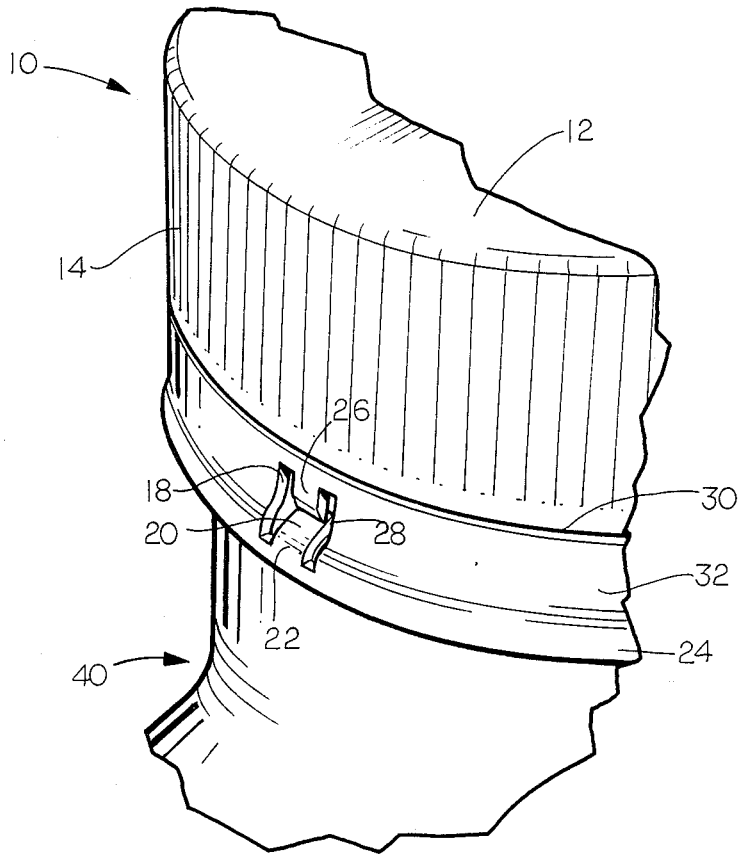
FIG. 2 is a fragmentary perspective view similar to FIG. 1 showing the closure thereof after a post forming operation has been performed thereon and after the closure has been applied to the finish of a bottle.
Figure 3:
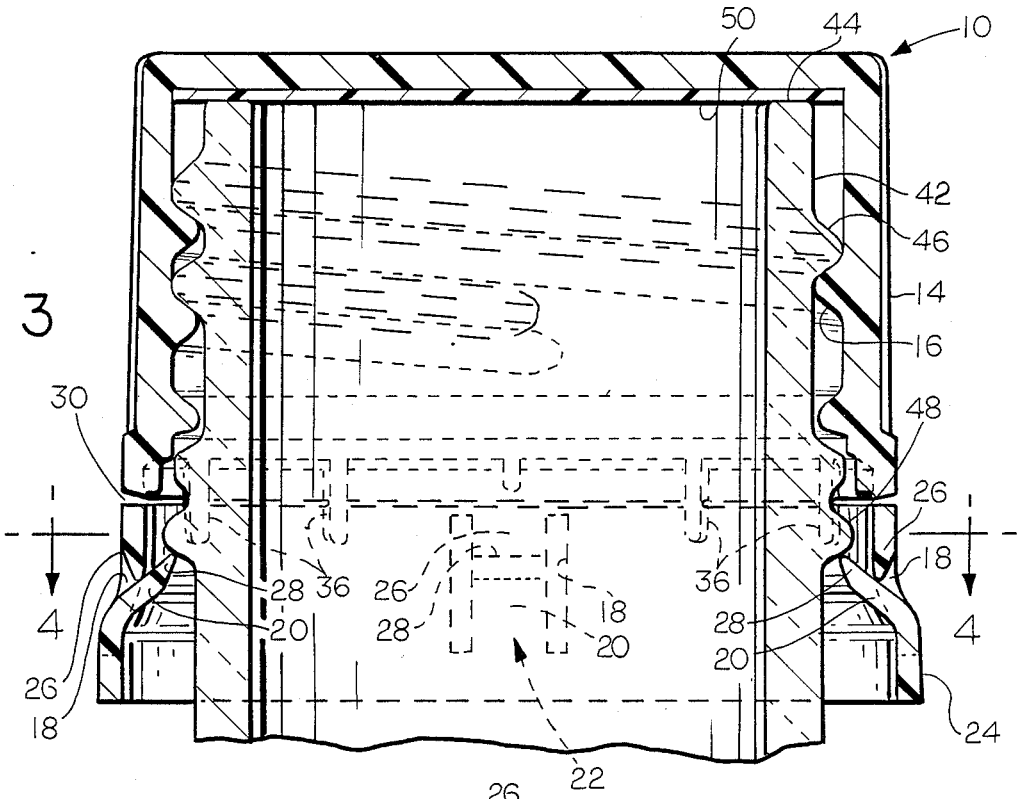
FIG. 3 is a vertical sectional view of a closure according to the present invention applied to the finish of a container.
Figure 4:
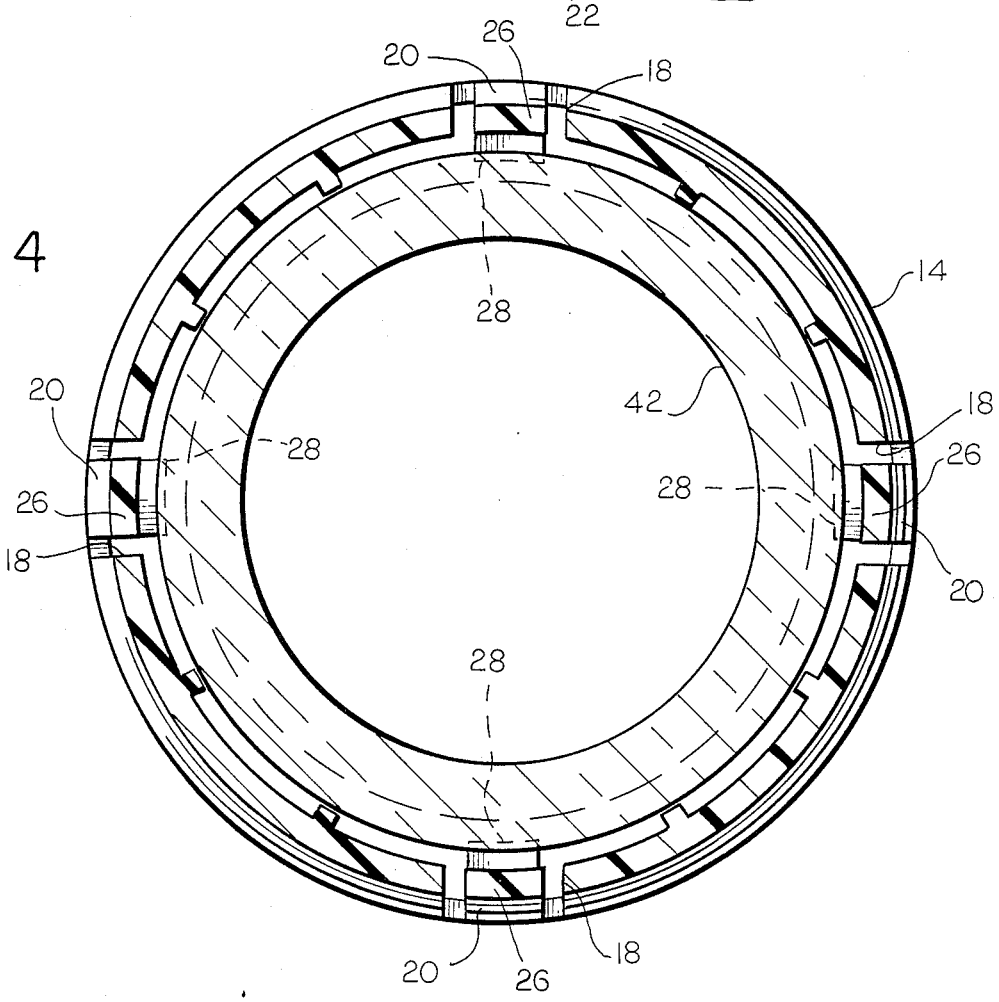
FIG. 4 is a view taken on line 4-4 of FIG. 3.

As is shown in FIGS. 2-4 of the drawing, a closure according to the present invention is indicated generally by reference numeral 10 and is shown in a closed position securely but removably engaging a bottle which is shown fragmentarily and which is indicated generally by reference numeal 40. The bottle 40, which may be a blown glass container or a blow molded plastic container, is provided with a finish portion 42, which terminates in a rim 44 that surrounds an open mouth of the bottle 40, and an outwardly projecting and helically extending thread 46. The bottle 40, for example, may be of the type which is used in the packaging of a beverage, for example, a pressurized beverage such as a carbonated soft drink or a non-pressurized or still beverage such as fruit juice, and many of such bottles are manufactured with a 28 millimeter finish diameter, that is, with a "T" dimension (in the terminology of the Glass Packaging Institute), the diameter at the outside of the thread 46, of approximately 28 millimeters. The finish 42 of the bottle 40 is also provided with an annular bead 48 at an elevation below that of the thread 46, and the function of the annular bead 48 will be hereinafter described.

Figure 1:
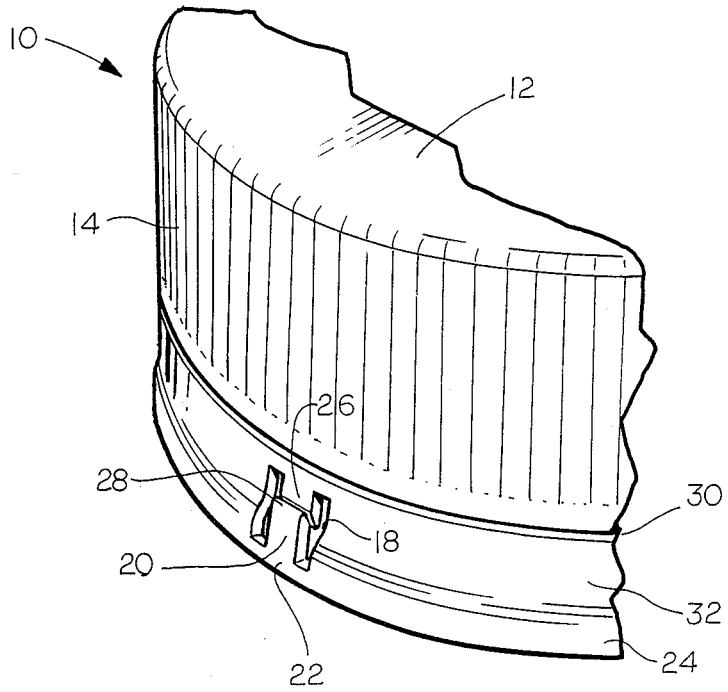
FIG. 1 is a fragmentary perspective view of a closure according to the present invention immediately after the manufacture of such closure and prior to the application of such closure to the finish of a bottle.

The closure 10 is molded in a single piece from a suitable flexible thermoplastic material, for example, a material made up principally of high density polyethylene, polypropylene or a flexible polyester or copolyester, plus, of course, customary additives such as colorants, plasticizers, and the like, and the closure 10 may be mass produced in its complex configuration from such a thermoplastic material relatively rapidly and inexpensively by conventional injection molding techniques and equipment. In any case, the closure 10 is made up of a top panel portion 12, which is generally horizontally disposed in the orientation of the closure 10 that is shown in FIGS. 1-3 of the drawing and which spans the rim 44 of the bottle 40, and an annular skirt portion 14 which extends downwardly from the top panel portion 12. The annular skirt portion 14 of the closure 10, which is knurled on its outside surface to enhance the gripping thereof, surrounds at least the upper portion of the finish portion 42 of the bottle 40 when the closure 10 is affixed to the affixed finish portion 42. The annular skirt portion 14 of the closure 10 is provided with an inwardly projecting and helically extending thread 16 which is complimentally engageable with the thread 46 of the bottle 40 to permit the closure 10 to be applied to the bottle 40 by a screwing on action and to be removed from the bottle 40 by an unscrewing action. If desired, a soft sealing liner 50, for example, a pulp liner or a foamed plastic liner, is inserted into the closure 10 against the underside of the top panel 12 of the closure 10 to help form a liquid tight seal between the closure 10 and the rim 44 of the bottle 40 when the closure 10 is tightly applied to the finish 42 of the bottle 40. Of course, the sealing liner 50 may be omitted by the use of a self-sealing or linerless closure design, for example, as is shown in U.S. Pat. No. 3,255,909 (I.H. Miller), a construction which has been popular for closures used in the packaging of distilled spirits.

The annular skirt portion 14 of the closure 10 is provided with at least one aperture 18 extending therethrough at an elevation in the lower part of such annular skirt portion. Preferably, the skirt portion 14 is provided with a plurality, shown as four in FIG. 5, of such apertures 18 in an evenly circumferentially spaced array thereof, the exact number of such apertures 18 being determined, mainly, by the "T" dimension of the bottle 40, four of such apertures 18 being suitable in a closure 10 designed for application to a bottle 40 with a "T" dimension of approximately 28 millimeters. The annular skirt portion 14 is also provided with a finger 20 at the location of each aperture 18 and in radial alignment therewith. Preferably, each finger 20 has a width, in the circumferential direction, which is less than the width of the adjacent aperture 18 and is circumferentially centered in relation to such adjacent aperture 18. Each finger 20 has a bottom end 22 which is fixed to the annular skirt portion 14, preferably to a radially enlarged bottom marginal portion 24 thereof, and an upper free end 28 which extends a little above the top of the adjacent aperture 18. Preferably, the top of the adjacent aperture is flexible in relation to the portion of the skirt portion 14 of the closure 10 from which is depends, and in the illustrated embodiment the flexibility is obtained by constructing the top of each aperture 18 in the form of a cantilevered, downwardly depending tab 26. After the closure 10 has been removed from the molding tooling, and before its application to the bottle 40, the upper end 28 of each finger 20 is pushed radially inwardly through the adjacent aperture 18, by tooling not shown, which is possible in spite of the interference between the upper end 28 of the finger 20 and the top of the adjacent aperture 18 because of the flexibility of the finger 20 as a result of its manufacture from a thermoplastic material and the flexibility of the cantilevered tab 26, and once the upper end 28 of the finger 20 has been pushed radially inwardly through the adjacent aperture 18 it will remain on the inside of the annular skirt portion 14 as a result of the interference. The positions of one of the fingers 20 before and after it has been pushed through an adjacent aperture 18 are shown respectively in FIGS. 1 and 2. Thus, after the upper end of each finger has been pushed through the aperture 18 which is adjacent thereto, and after the closure 10 has been applied to the bottle 40, the upper end 28 of each finger 20 will engage the underside of the annular bead 48 of the bottle 40 in an interference fit, and the application of the closure 10 to the bottle 40, notwithstanding such interference fit, can be achieved by the outward flexing of the cantilevered tabs 26 as the upper ends 28 of the fingers 20 pass over the annular bead 48.

Figure 5:
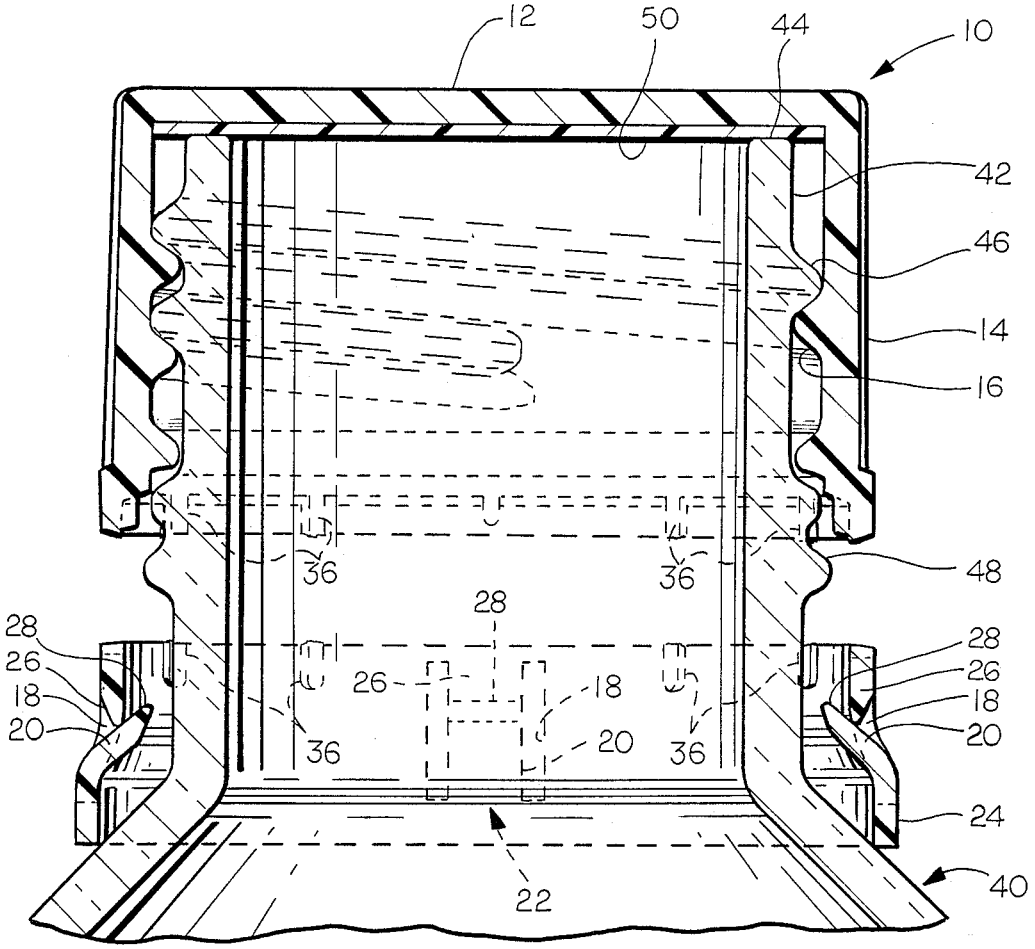
FIG. 5 is a view similar to FIG. 3 showing the closure after an initial opening attempt.

The annular skirt portion 14 of the closure 10 is scored or otherwise deformed along a circumferentially extending weakened line 30 (FIGS. 1, 2, and 4) after the closure 10 has been removed from the mold tooling which is used to manufacture it, and preferably before it is attached to the bottle 10, the weakened line 30 being positioned at an elevation between the elevation of the bottom end 22 of each finger and the elevation of the thread 16 of the closure 10. Thus, the weakened line 30 forms a ring 32 at the bottom of the skirt portion 14 of the closure 10, and the ring 32 is frangible with respect to the portion of the skirt portion 14 of the closure 10 which is above the weakened line 30, and breaks away readily therefrom when the closure 10 is removed from the bottle 40 due to the interference between the upper end 28 of each finger 20 and the underside of the annular bead 48, as is shown in FIG. 5 of the drawing.

Because of the fact that each finger 20 is molded in a position in which its upper end 28 is located on the outside of the skirt portion 14 of the closure 10, rather than on the inside of the annular skirt portion 14, during molding the upper end of each finger 20 is not in interference with the portion of the mold tooling, and specifically the portion of the core pin thereof, which is used to form the thread 16 of the closure 10. Because of this fact, the closure 10 can be removed from the core pin by stripping, as opposed to unscrewing, so long as such stripping process is otherwise compatible with other requirements of the closure 10. Preferably, the skirt portion 14 of the closure 10 will flare by a slight amount as it extends downwardly from the top panel portion 12 to facilitate the molding of the finger 20.

To help in overcoming the tamper indicating features of the package which is made up of the closure 10 and the bottle 40 by localized decentering the skirt portion 14 of the closure 10 on the bottle 40, similar to the removal of the tire from a rim, the inside of the skirt portion 14 of the closure 10 is provided with a circumferential series of spaced apart, inwardly projecting vertical ribs 36. The vertical ribs 36 are positioned to lie closely adjacent to the annular bead 48 when the closure 10 is securely applied to the bottle 40. As is shown in FIG. 3, the vertical ribs 36 are offset from the apertures 18 so as to avoid interfering with the functioning of the fingers 20. When such vertical ribs are used, the weakened line 30 extends entirely through the thickness of the skirt portion 14 of the closure 10 and partly into the thickness of the ribs 36.

Although the best mode contemplated by the inventor for carrying out the present invention as of the filing date hereof has been shown and described herein, it will be apparent to those skilled in the art that suitable modifications, variations and equivalents may be made without departing from the scope of the invention, such scope being limited solely by the terms of the following claims.

What is claimed is:

1. A removable, tamper indicating closure for engaging the finish portion of a bottle, the finish portion terminating in a rim and including outwardly projecting annular bead means and closure engaging means positioned between the annular bead means and the rim, the annular bead means having an underside, said closure comprising, in combination:

a top panel portion adapted to span the finish portion of the container; and an annular skirt portion extending downwardly from said top panel portion and being adapted to surround an upper portion of the finish portion of the bottle including the rim and the annular bead means, said annular skirt portion having an outside, an inside, and a bottom margin and including;

finish portion engaging means projecting radially inwardly from said annular skirt portion for securely removably engaging the closure engaging means of the finish portion of the bottle;

at least one aperture in said annular skirt portion, said at least one aperture being positioned between said bottom margin and said finish portion engaging means;

a flexible finger formed on said outside of said annular skirt portion in radial alignment with said at least one aperture, said flexible finger having a bottom end which is attached to said annular skirt portion and an upper free end, an upper portion of said flexible finger including said upper free end being deflectable through said at least one aperture from said outside of said annular skirt so that said upper free end is adapted to engage the underside of the annular bead means in an interference fit; and circumferentially extending weakened line means in said annular skirt portion above said bottom margin and said bottom end of said flexible finger, said weakened line means and said bottom margin defining a breakaway ring portion of said annular skirt portion, said breakaway ring portion being frangible with respect to a remainder portion of said annular skirt portion upon the first removal or attempted removal of said closure from the bottle to provide a visually detectable indication of the first removal or attempted removal.

2. A closure according to claim 1 wherein said top panel portion and said annular skirt portion are formed integrally in a single piece from a thermoplastic material.

3. A closure according to claim 2 wherein said single piece is formed by injection molding.

4. A closure according to claim 3 wherein said thermoplastic material has a principal ingredient which is selected from the group consisting of high density polyethylene, polypropylene, and flexible polyesters and copolyesters.

5. A closure according to claim 3 wherein said flexible finger is attached to said annular skirt portion at a location and extends from said location toward said top panel portion substantially parallel to said annular skirt portion in its as molded condition.

6. A closure according to claim 1 wherein the closure engaging means of the finish portion of the bottle comprises outwardly projecting, helically extending thread means, and wherein said finish portion engaging means of said closure comprises inwardly projecting, helically extending thread means, said inwardly projecting, helically extending thread means of said closure being complemental with the outwardly projecting, helically extending thread means of the finish portion of the bottle, whereby said closure may be applied to the finish portion of the bottle by a screwing on action and removed from the finish portion of the bottle without said breakaway ring portion thereof by an unscrewing action.

7. A closure according to claim 6 wherein said top panel portion and said annular skirt portion are formed integrally in a single piece from a thermoplastic material.

8. A closure according to claim 7 wherein said single piece is formed by injection molding.

9. A closure according to claim 8 wherein said thermoplastic material has a principal ingredient which is selected from the group consisting of high density polyethylene, polypropylene, and flexible polyesters and copolyesters.

10. A closure according to claim 8 wherein said closure is stripped from tooling used in forming said closure by injection molding.

11. A closure according to claim 1 wherein said at least one aperture has a top and wherein said upper free end of said flexible finger extends above said top of said at least one aperture.

12. A closure according to claim 1 wherein said flexible finger is attached to said annular skirt portion at a location above said bottom margin annular skirt portion.

13. A removable, tamper indicating closure for engaging the finish portion of a bottle, the finish portion terminating in a rim and including outwardly projecting annular bead means and closure engaging means positioned between the annular bead means and the rim, the annular bead means having an underside, said closure comprising, in combination:

a top panel portion adapted to span the finish portion of the container; and an annular skirt portion extending downwardly from said top panel portion and being adapted to surround an upper portion of the finish portion of the bottle including the rim and the anular bead means, said annular skirt portion having an outside, an inside, and a bottom margin and including;

finish portion engaging means projecting radially inwardly from said annular skirt portion for securely removably engaging the closure engaging means of the finish portion of the bottle;

at least one aperture in said annular skirt portion, said at least one aperture being positioned between said bottom margin and said finish portion engaging means;

a flexible finger formed on said outside of said annular skirt portion in radial alignment with said at least one aperture, said flexible finger having a bottom end which is attached to said annular skirt portion and an upper free end, an upper free end being deflectable through said at least one aperture so that said upper free end is adapted to engage the underside of the annular bead means in an interference fit; and circumferentially extending weakened line means in said annular skirt portion above said bottom margin and said bottom end of said flexible finger, said weakened line means and said bottom margin defining a breakaway ring portion of said annular skirt portion, said breakaway ring portion being frangible with respect to a remainder portion of said annular skirt portion upon the first removal or attempted removal of said closure from the bottle to provide a visually detectable indication of the first removal or attempted removal;

wherein said at least one aperture has a top and wherein said upper free end of said flexible finger extends above said top of said at least one aperture.

14. A closure according to claim 13 wherein said top is in the form of the bottom edge of a flexible, downwardly depending cantilevered tab.

15. A removable, tamper indicating closure for engaging the finish portion of a bottle, the finish portion terminating in a rim and including outwardly projecting annular bead means and closure engaging means positioned between the annular bead means and the rim, the annular bead means having an underside, said closure comprising, in combination:

a top panel portion adapted to span the finish portion of the container; and an annular skirt portion extending downwardly from said top panel portion and being adapted to surround an upper portion of the finish portion of the bottle including the rim and the annular bead means, said annular skirt portion having an outside, an inside, and a bottom margin and including;

finish portion engaging means projecting radially inwardly from said annular skirt portion for securely removable engaging the closure engaging means of the finish portion of the bottle;

at least one aperture in said annular skirt portion, said at least one aperture being positioned between said bottom margin and said finish portion engaging means;

a flexible finger formed on said outside of said annular skirt portion in radial alignment with said at least one aperture, said flexible finger having a bottom end which is attached to said annular skirt portion and an upper free end, and upper portion of said flexible finger including said upper free end being deflectable through said at least one aperture so that said upper free end is adapted to engage the underside of the annular bead means in an interference fit; and circumferentially extending weakened line means in said annular skirt portion above said bottom margin and said bottom end of said flexible finger, said weakened line means and said bottom margin defining a breakaway ring portion of said annular skirt portion, said breakaway ring portion being frangible with respect to a remainder portion of said annular skirt portion upon the first removal or attempted removal of said closure from the bottle to provide a visually detectable indication of the first removal or attempted removal;

wherein said annular skirt further has a circumferential series of spaced apart inwardly projecting ribs, said at least one aperture further being positioned between an adjacent pair of said ribs.

16. A removable, tamper indicating closure for engaging the finish portion of a bottle, the finish portion terminating in a rim and including outwardly projecting annular bead means and closure engaging means positioned between the annular bead means and the rim, the annular bead means having an underside, said closure comprising, in combination:

a top panel portion adapted to span the finish portion of the container; and an annular skirt portion extending downwardly from said top panel portion and being adapted to surround an upper portion of the finish portion of the bottle including the rim and the annular bead means, said annular skirt portion having an outside, and inside, and a bottom margin and including;

finish portion engaging means projecting inwardly from said annular skirt portion for securely removably engaging the closure engaging means of the finish portion of the bottle;

a plurality of circumferentially spaced apart apertures in said annular skirt portion, said plurality of apertures being positioned between said bottom margin and said finish portion engaging means; and a plurality of circumferentially spaced apart flexible fingers, each of said flexible fingers being formed on said outside of said annular skirt portions in radial alignment with an adjacent one of said plurality of apertures, said each of said fingers having a bottom end which is attached to said annular skirt portion and an upper free end, an upper portion including said upper free end of said each of said plurality of flexible fingers being deflectable through said adjacent one of said plurality of apertures from said outside of said annular skirt so that said upper free end of said each of said flexible fingers is adapted to engage the underside of the annular beam means in an interference fit; and circumferentially extending weakened line means in said annular skirt portion above said bottom margin and said bottom end of said each of said flexible fingers, said weakened line means and said bottom margin defining a breakaway ring portion of said annular skirt portion, said breakaway ring portion being frangible with respect to a remainder portion of said annular skirt portion upon the first removal or attempted removal of said closure from said bottle to provide a visually detectable indication of the first removal or attempted removal.

17. A closure according to claim 16 wherein said top panel portion and said annular skirt portion are formed integrally in a single piece from a thermoplastic material.

18. A closure according to claim 17 wherein said single piece is formed by injection molding.

19. A closure according to claim 18 wherein said thermoplastic material has a principal ingredient which is selected from the group consisting of high density polyethylene, polypropylene, and flexible polyesters and copolyesters.

20. A closure according to claim 18, wherein each of said plurality of fingers is attached to said annular skirt portion at a location and extends from said location toward said top panel portion substantially parallel to said annular skirt portion in its as molded condition.

21. A closure according to claim 16 wherein the closure engaging means of the finish portion of the bottle comprises outwardly projecting, helically extending thread means, and wherein said finish portion engaging means of said closure comprises inwardly projecting, helically extending thread means, said inwardly projecting, helically extending thread means of said closure being complemental with the outwardly projecting, helically extending thread means of the finish portion of the bottle, whereby said closure may be applied to the finish portion of the bottle by a screwing on action and removed from the finish portion of the bottle without said breakaway ring portion thereof by an unscrewing action.

22. A closure according to claim 21 wherein said top panel portion and said annular skirt portion are formed integrally in a single piece from a thermoplastic material.

23. A closure according to claim 22 wherein said single piece is formed by injection molding.

24. A closure according to claim 23 wherein said thermoplastic material has a principal ingredient which is selected from the group consisting of high density polyethylene, polypropylene, and flexible polyesters and copolyesters.

25. A closure according to claim 23 wherein said closure is stripped from tooling used in forming said closure by injection molding.

26. A closure according to claim 16 wherein said each of said plurality of apertures has a top and wherein said upper free end of said each of said plurality of flexible fingers extends above said top of said adjacent one of said plurality of apertures.

27. A closure according to claim 16 wherein each of said plurality of flexible fingers is attached to said annular skirt portion at a location above said bottom margin of said annular skirt portion.

28. A removable, tamper indicating closure for engaging the finish portion of a bottle, the finish portion terminating in a rim and including outwardly projecting annular bead means and closure engaging means positioned between the annular bead means and the rim, the annular bead means having an underside, said closure comprising, in combination:

a top panel portion adapted to span the finish portion of the container; and an annular skirt portion extending downwardly from said top panel portion and being adapted to surround an upper portion of the finish portion of the bottle including the rim and the annular bead means, said annular skirt portion having an outside, an inside, and a bottom margin and including;

finish portion engaging means projecting inwardly from said annular skirt portion for securely removably engaging the closure engaging means of the finish portion of the bottle;

a plurality of circumferentially spaced apart apertures in said annular skirt portion, said plurality of apertures being positioned between said bottom margin and said finish portion engaging means;

a plurality of circumferentially spaced apart flexible fingers, each of said flexible fingers being formed on said outside of said annular skirt portions in radial alignment with an adjacent one of said plurality of apertures, said each of said fingers having a bottom end which is attached to said annular skirt portion and an upper free end, an upper portion including said upper free end of said each of said plurality of flexible fingers being deflectable through said adjacent one of said plurality of apertures so that said upper free end of said each of said flexible fingers is adapted to engage the underside of the annular bead means in an interference fit; and circumferentially extending weakened line means in said annular skirt portion above said bottom margin and said bottom end of said each of said flexible fingers, said weakened line means and said bottom margin defining a breakaway ring portion of said annular skirt portion, said breakaway ring portion being frangible with respect to a remainder portion of said annular skirt portion upon the first removal or attempted removal of said closure from said bottle to provide a visually detectable indication of first removal or attempted removal;

wherein said each of said plurality of apertures has a top and wherein said upper free end of said each of said plurality of flexible fingers extends above the top of said adjacent one of said plurality of apertures.

29. A closure according to claim 28 wherein said top is in the form of the bottom edge of a flexible, downwardly depending cantilevered tab.

30. A tamper indicating package comprising, in combination:

a bottle having a finish portion, said finish portion terminating in a rim and including outwardly projecting annular bead means and closure engaging means positioned between said annular bead means and said rim, said annular bead means having an underside; and a closure comprising, in combination;

a top panel portion spanning said finish portion of said container; and an annular skirt portion extending downwardly from said top panel portion and surrounding an upper portion of said finish portion of said bottle including said rim and said annular bead means, said annular skirt portion having an outside, an inside, and a bottom margin and including;

finish portion engaging means projecting radially inwardly from said annular skirt portion, said at least one aperture being positioned between said bottom margin and said finish portion engaging means;

at least one aperture in said annular skirt portion, said at least one aperture being positioned between said bottom margin and said finish portion engaging means; and a flexible finger formed on said outside of said annular skirt portion in radial alignment with said at least one aperture, said flexible finger having a bottom end which is attached to said annular skirt portion and an upper free end, an upper portion of said flexible finger including said upper free end being deflected through said at least one aperture from said outside of said annular skirt so that said upper free end engages said underside of said annular bead means in an interference fit; and circumferentially extending weakened line means in said annular skirt portion above said bottom margin and said bottom end of said flexible finger, said weakened line means and said bottom margin defining a breakaway ring portion of said annular skirt portion, said breakaway ring portion being frangible with respect to a remainder portion of said annular skirt portion upon the first removal or attempted removal of said closure from said bottle to provide a visually detectable indication of the first removal or attempted removal.

31. A package according to claim 30 wherein said top panel portion of said closure and said annular skirt portion of said closure are formed integrally in a single piece from a thermoplastic material.

32. A package according to claim 31 wherein said single piece is formed by injection molding.

33. A package according to claim 32 wherein said thermoplastic material has a principal ingredient which is selected from the group consisting of high density polyethylene, polypropylene, and flexible polyesters and copolyesters.

34. A package according to claim 32 wherein said flexible finger is attached to said annular skirt portion at a location and extends from said location toward said top panel portion substantially parallel to said annular skirt portion in its as molded condition.

35. A package according to claim 30 wherein said closure engaging means of said finish portion of said bottle comprises outwardly projecting, helically extending thread means, and wherein said finish portion engaging means of said closure comprises inwardly projecting, helically extending thread means, said inwardly projecting, helically extending thread means of said closure being complemental with said outwardly projecting, helically extending thread means of said finish portion of said bottle, whereby said closure may be applied to said finish portion of the bottle by a screwing on action and removed from said finish portion of said bottle without said breakaway ring portion thereof by an unsrewing action.

36. A package according to claim 35 wherein said top panel portion of said closure and said annular skirt portion of said closure are formed integrally in a single piece from a thermoplastic material.

37. A package according to claim 36 wherein said single piece is formed by injection molding.

38. A package according to claim 37 wherein said thermoplastic material has a principal ingredient which is selected from the group consisting of high density polyethylene, polypropylene, and flexible polyesters and copolyesters.

39. A package according to claim 37 wherein said closure is stripped from tooling used in forming said closure by injection molding.

40. A package according to claim 30 wherein said at least one aperture has a top and wherein said upper free end of said flexible finger extends above said top of said at least one aperture.

41. A package according to claim 30 wherein said top panel portion of said closure has an underside and further comprising:

sealing means compressed between said underside of said top panel portion of said closure and said rim of said finish portion of said bottle and forming a seal therebetween.

42. A package according to claim 41 wherein said sealing means comprises soft sealing liner means.

43. A package according to claim 30 wherein said annular skirt portion of said closure further has a circumferential series of spaced apart, inwardly projecting ribs, said at least one aperture of said closure further being positioned between an adjacent pair of said ribs, said ribs lying closely adjacent to said annular bead means of said bottle and serving to prevent the localized decentering of said annular skirt portion of said closure with respect to said bottle.

44. A tamper indicating package comprising, in combination:

a bottle having a finish portion, said finish portion terminating in a rim and including outwardly projecting annular bead means and closure engaging means positioned between said annular bead means and said rim, said annular bead means having an underside; and a closure comprising, in combination;

a top panel portion spanning said finish portion of said container; and an annular skirt portion extending downwardly from said top panel portion and surrounding an upper portion of said finish portion of said bottle including said rim and said annular bead means, said annular skirt portion having an outside, an inside, and a bottom margin and including;

finish portion engaging means projecting radially inwardly from said annular skirt portion, said at least one aperture being positioned between said bottom margin and said finish portion engaging means;

at least one aperture in said annular skirt portion, said at least one aperture being positioned between said bottom margin and said finish portion engaging means; and a flexible finger formed on said outside of said annular skirt portion in radial alignment with said at least one aperture, said flexible finger having a bottom end which is attached to said annular skirt portion and an upper free end, an upper portion of said flexible finger including said upper free end being deflected through said at least one aperture so that said upper free end engages said underside of said annular bead means in an interference fit; and circumferentially extending weakened line means in said annular skirt portion above said bottom margin and said bottom end of said flexible finger, said weakened line means and said bottom margin defining a breakaway ring portion of said annular skirt portion, said breakaway ring portion being frangible with respect to a remainder portion of said annular skirt portion upon the first removal or attempted removal of said closure from said bottle to provide a visually detectable indication of the first removal or attempted removal;

wherein said at least one aperture has a top and wherein said upper free end of said flexible finger extends above said top of said at least one aperture.

45. A package according to claim 44 wherein said top is in the form of the bottom edge of a flexible, downwardly depending cantilevered tab.

46. A package according to claim 30 wherein said flexible finger is attached to said annular skirt portion at a location above said bottom margin of said annular skirt portion.

* * * * *